US006675770B1

(12) United States Patent
Sato et al.

(10) Patent No.: US 6,675,770 B1
(45) Date of Patent: Jan. 13, 2004

(54) PRESSING DEVICE AND FRICTION PLATE FOR IMPROVING RESPONSE SENSITIVITY OF ACCELERATOR OPERATION

(75) Inventors: Seiji Sato, Iwata (JP); Akihiko Matsuoka, Iwata (JP); Satoru Fukuzawa, Mie-ken (JP)

(73) Assignee: NTN Corporation, Osaka (JP)

( * ) Notice: Subject to any disclaimer, the term of this patent is extended or adjusted under 35 U.S.C. 154(b) by 0 days.

(21) Appl. No.: 09/648,783

(22) Filed: Aug. 28, 2000

(30) Foreign Application Priority Data

Sep. 7, 1999 (JP) ..... 11-252514
Sep. 7, 1999 (JP) ..... 11-252525

(51) Int. Cl.[7] ..... F02D 9/02

(52) U.S. Cl. ..... 123/396; 74/822; 74/824; 100/176

(58) Field of Search ..... 74/822, 824; 100/176; 123/396

(56) References Cited

U.S. PATENT DOCUMENTS 4,050,803 A * 9/1977 McCarroll ..... 355/3 R
RE34,302 E * 7/1993 Imoehl ..... 123/399
5,819,646 A * 10/1998 Fukunaga ..... 100/176

FOREIGN PATENT DOCUMENTS

| | | |
|---|---|---|
| JP | 5941708 | 3/1984 |
| JP | 9236030 | 9/1997 |
| JP | 9280076 | 10/1997 |

* cited by examiner

*Primary Examiner*—Hieu T. Vo
*Assistant Examiner*—Johnny H. Hoang
(74) *Attorney, Agent, or Firm*—Hedman & Costigan, P.C.

(57) ABSTRACT

A pressing device for an apparatus for imparting a friction resistance to a rotary shaft driving an engine-output control device directly or indirectly to apply a resistance to an operation of an accelerator. The pressing device is a molded product made of a resinous material whose flexural strength is 50 MPa or higher and flexural modulus of elasticity is 3,300 MPa or higher.

When a friction plate is formed compositely with a plate-shaped member to form the pressing device, friction plate is formed of a fluorocarbon resin; and at least one ingredient selected from a whisker whose Mohs hardness is 5 or less, a carbon fiber, and a hard resinous powder.

4 Claims, 2 Drawing Sheets

PRESSING DEVICE AND FRICTION PLATE FOR IMPROVING RESPONSE SENSITIVITY OF ACCELERATOR OPERATION

BACKGROUND OF THE INVENTION

The present invention relates to a pressing device and a friction plate for improving response sensitivity of accelerator operation, provided in a system for directly or indirectly driving an engine-output control device, for example, an intake throttle valve, according to a pressed amount of an accelerator.

In a gasoline engine vehicle, opening and closing the intake throttle valve perform the control of the engine output. In a diesel engine vehicle, rotating a plunger of an injection pump performs the control of the engine output.

To perform control of the engine output, a wire cable connects an accelerator pedal to the output control device, for example, the intake throttle valve or the plunger of the injection pump. Thus, the output control device is driven according to a driver's operation of the accelerator.

In recent years, an actuator method is in practical use to control the output control of the gasoline engine vehicle. In the actuator method, a pressed amount of the accelerator is converted into an electric signal to operate an actuator so that the actuator opens and closes the intake throttle valve (Japanese Utility Model Application Laid-Open No. 59-41708).

In the actuator method, because a wire cable is much shorter than that of the conventional one, the degree of the resistance of the wire cable applied to driver's foot is small. Thus, the driver has difficulty in operating the accelerator, which may cause the driver to be much fatigued and an accident to occur.

This problem also occurs in the diesel engine vehicle when the system adopts a short wire cable.

To overcome the problem, an apparatus for improving a response sensitivity of the accelerator operation is known (Japanese Patent Application Laid-Open Nos. 9-280076, 9-236030).

In the apparatus disclosed in Japanese Patent Application Laid-Open No. 9-236030, the wire cable connects the rotary shaft for driving the engine-output control device directly or indirectly to the accelerator pedal so that a resistance is applied to the rotary shaft, of the mechanism for driving the output control device, that rotates according to an operated amount of the accelerator. The pressing device in the apparatus has a metal plate for preventing deformation such as flexure and a sheet-shaped friction plate, for example, the friction plate, made of fluorocarbon resin, bonded to the metal plate. The pressing device is constantly elastically pressed against a disk fixed to the rotary shaft by means of a spring member, which allows a driver to perform the operation of the accelerator smoothly.

The friction plate is used to generate a difference between the accelerator pedal-pressing force and the return force of the accelerator. If the difference is small, the accelerator pedal is moved by a slight change of the accelerator pedal-pressing force, although the driver desires a vehicle speed constant by pressing the accelerator pedal to a certain degree. Thus, it is difficult for the driver to operate the accelerator pedal. If the difference is large, it is easy for the driver to operate the accelerator pedal when the driver desires a vehicle speed constant by pressing the accelerator pedal to a certain degree. However, when the driver changes the vehicle speed, the driver feels uncomfortable in the operation of the accelerator pedal. That is, the driver feels that the accelerator pedal is heavy in pressing it, and it is difficult for the driver to return the accelerator pedal to an original position.

However, the above-described pressing device having the plate-shaped member bonded to the sheet-shaped friction plate made of fluorocarbon resin is inferior in the resistance to creep and self-wearability that are required for the pressing device for use in the apparatus for improving response sensitivity of accelerator operation by applying a resistance to accelerator operation.

Consequently, the feeling for the accelerator pedal is varied owing to a fluctuation of a pressing load of the pressing device caused by creep and self-wear. Further, chattering in the rotation of the pressing device and the return function of the accelerator deteriorate.

Another problem of the above-described pressing device is that there is a fear that the plate-shaped member and the sheet-shaped friction plate made of fluorocarbon resin may separate from each other. Still another problem of the above-described pressing device is that a bonding process is essential in the process of producing the pressing device. That is, the pressing device is produced with poor productivity.

SUMMARY OF THE INVENTION

The present invention has been made in view of the above-described situation. Thus, it is an object of the present invention to provide a pressing device, for an apparatus for improving response sensitivity of accelerator operation, superior in productivity because of elimination of a bonding process, having an appropriate degree of a frictional force and sliding-contact performance, and having an improved resistance to wear.

It is another object of the present invention to provide a friction plate, for the pressing device, which is made of fluorocarbon resin and used in combination with a plate-shaped member and which has an appropriate degree of a frictional force and sliding-contact performance, and having a greatly improved resistance to wear and creep.

The pressing device of the present invention, for improving response sensitivity of accelerator operation, for imparting a friction resistance to a rotary shaft driving an engine-output control device directly or indirectly to apply a resistance to an operation of an accelerator comprises a molded product made of a resinous material whose flexural strength is 5 MPa or higher and a flexural modulus of elasticity is 3,300 MPa or higher.

The pressing device can be obtained as a mono block molding product by the resinous material having flexural strength of 50 MPa or higher and the flexural modulus of elasticity of 3,300 MPa or higher.

The resinous material is injection-moldable and consists of one of the following resins or a mixture thereof: polyphenylene sulfide resin (hereinafter referred to as PPS), polyimide resin (hereinafter referred to as PI), polyamideimide resin (hereinafter referred to as PAI), polyether imide resin (hereinafter referred to as PEI), polyether ether ketone resin (hereinafter referred to as PEEK), polyether ketone resin (hereinafter referred to as PEK), polyether nitrile resin (hereinafter referred to as PEN), polyamide resin (hereinafter referred to as PA), aromatic polyester resin, and polyacetal resin (hereinafter referred to as POM).

The resinous material is a resinous composition containing a solid lubricant added to the injection-moldable resin. The solid lubricant is powder of tetrafluoroethylene resin. It is possible to improve the resistance of the pressing device that is an monoblock molding product by adding the solid lubricant to the injection-moldable resin.

The other resinous material for the pressing device of the present invention has a flexural strength of 50 MPa or higher and a flexural modulus of elasticity of 3,300 MPa or higher and consists of a molded product of thermosetting resin. The thermosetting resin is aromatic thermosetting resin or phenol resin.

The friction plate of the present invention, for improving response sensitivity of accelerator operation, imparts a friction resistance to a rotary shaft driving an engine-output control device directly or indirectly to apply a resistance to an operation of an accelerator. The friction plate comprises a fluorocarbon resinous composition containing fluorocarbon resin and at least one of a whisker whose Mohs hardness is 5 or less, a carbon fiber, and a hard resinous powder.

The fluorocarbon resin is selected from tetrafluoroethylene (hereinafter referred to as PTFE) and/or modified tetrafluoroethylene (hereinafter referred to as modified PTFE).

Owing to the action of the ingredient such as the whisker, the carbon fiber and/or the hard resinous powder, it is possible to greatly improve the wear and creep resistance of the fluorocarbon resinous composition of the friction plate.

DETAILED DESCRIPTION OF THE PREFERRED EMBODIMENTS

Figure 1:
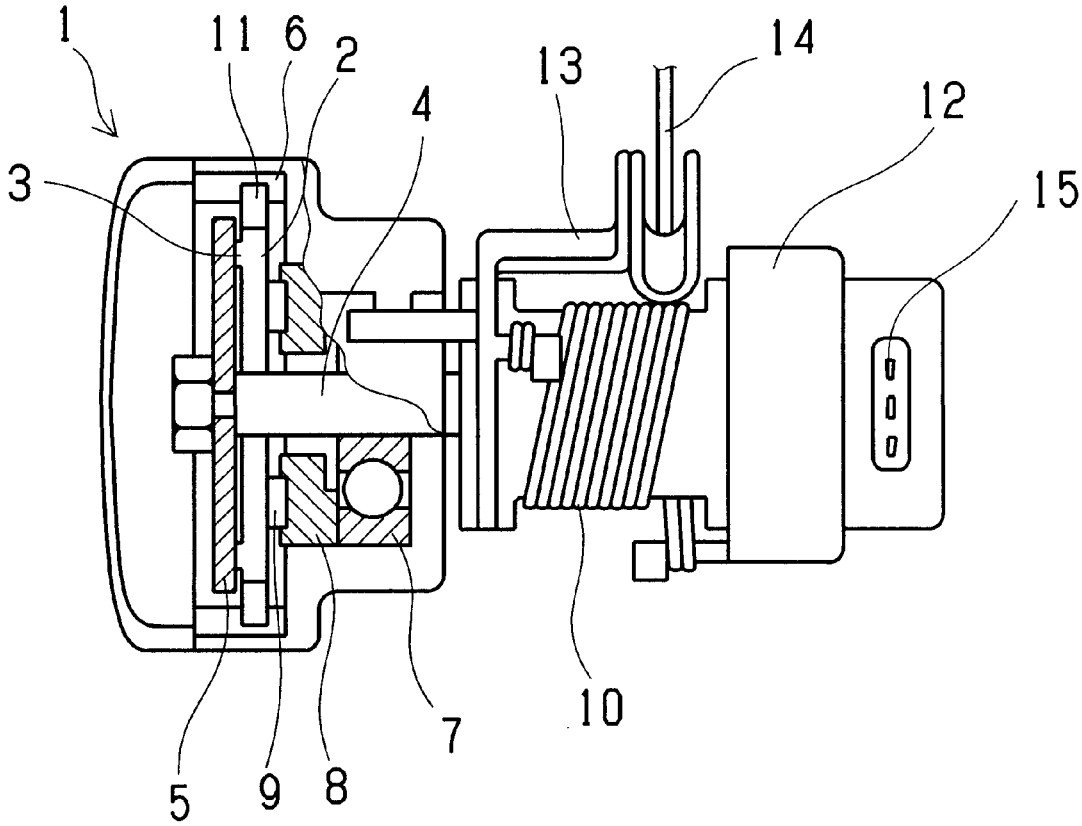
FIG. 1 shows an example of an apparatus for improving response sensitivity of accelerator operation.

As an embodiment of the present invention, FIG. 1 shows an example of an apparatus, for improving response sensitivity of accelerator operation (hereinafter referred to as sensitivity improving apparatus), installed at the end of a rotary shaft extending from an accelerator sensor unit.

The sensitivity improving apparatus 1 is installed at the end of a rotary shaft 4 extending from an accelerator sensor unit 12 and supported by a rolling bearing 7. The sensitivity improving apparatus 1 is accommodated in a housing. The housing accommodates the rolling bearing 7, a spacer 8, a spring washer 9, and a pressing device 2 in this order from the bottom portion of the housing in the axial direction of the rotary shaft 4.

The pressing device 2 is a molded product of synthetic resin and has a projection 11 formed on the peripheral surface thereof. The projection 11 fits in a concave portion 6 in the housing, thus preventing rotation of the pressing device 2.

A disk 5 mating with the pressing device 2 is strongly fixed with a bolt to the axial end of the rotary shaft 4. The disk 5 rotates with the rotation of the rotary shaft 4.

The rotary shaft 4 rotates forward by the operation of an accelerator lever connected to a wire cable 14 when an accelerator is pedaled and rotates backward by a return force of a return spring 10 when the accelerator is returned to the original position.

A projected contact portion 3 formed on the pressing device 2 is pressed against the metal disk 5 through the spring washer 9. A frictional force is generated on the rotary shaft 4 owing to a friction resistance caused by the pressing when it rotates backward by the return force of the return spring 10. The friction force generated on the rotary shaft 4 acts as a resistance in operating the accelerator and improves response sensitivity of accelerator operation. Reference numeral 15 denotes an output terminal.

Preferably, the pressing device 2 is made of a resinous material having an appropriate degree of a frictional force and sliding-contact performance and a high degree of flexural rigidity and a flexural modulus of elasticity to prevent generation of deformation such as flexure. The flexural rigidity and the flexural modulus of elasticity are measured in accordance with the test method specified in ASTM D790. It is necessary that the flexural rigidity of the resinous material is 50 MPa or more. If the flexural rigidity of the resinous material is less than 50 MPa, there is a possibility that it is damaged or broken. It is necessary that the flexural modulus of elasticity of the resinous material 3,3000 MPa or more. If the flexural modulus of elasticity of the resinous material is less than 3,300 MPa, it cannot have satisfactory resistance to creep. It is preferable that the resinous material can be injection-molded.

It is possible to obtain the pressing device 2, for the sensitivity improving apparatus, serving as both a holding member and a friction plate by injection-molding an injection-moldable resinous material whose flexural rigidity is 50 MPa or more and flexural modulus of elasticity is 3,3000 MPa or more.

The injection-moldable resinous material whose flexural rigidity is 50 MPa or more and flexural modulus of elasticity is 3,3000 MPa or more may consist of a thermoplastic resin or a thermosetting resin. The thermoplastic resin includes PI, PEI, PAI, PPS, PEEK, PEK, PEN, PA, aromatic polyester resin, and POM.

The thermosetting resin includes thermosetting polyimide resin, aromatic thermosetting resin, phenol resin, and epoxyresin. These resins can be used singly or as a mixture thereof.

Of these resins, the following resins are preferable because they are excellent in resistance to wear and friction characteristic: PI, PEI, PAI, PPS, PEEK, PEK, PEN, PA, the aromatic polyester resin, the aromatic thermosetting resin, and the phenol resin.

The upper limit of the flexural rigidity is 400 MPa. The upper limit of the flexural modulus of elasticity is 35,000 MPa.

As a solid lubricant, it is possible to use PTEE, graphite, molybdenum disulfide, and the like. These substances can be used singly or as a mixture thereof. The PTEE is superior in lubricant property and thus can be preferably used. As the polymerization method of the PTFE, it is possible to adopt the suspension polymerization method for preparing molding powder or the emulsion polymerization method for preparing fine powder. It is possible to use PTFE powder prepared by heating virgin PTFE of the molding powder under pressure and the fine powder under pressure and pulverizing it and PTFE powder prepared by irradiating the virgin PTFE with γ rays, because these PTFE powders are superior in lubricant property. These PTFE powders are called recycled PTFE.

In addition to the solid lubricant, a reinforcing material can be added to the resinous material. It is possible to improve the mechanical characteristic of the resinous material and allow the flexural rigidity and flexural modulus of elasticity thereof to be in a predetermined range by adding the reinforcing material thereto. Such a resinous material can be used to the pressing device of the present invention.

As the reinforcing material that can be preferably added to the resinous material, whiskers and carbon fibers can be used singly or as a mixture thereof.

The whisker is a single crystal having its aspect ratio is 10 or more. Preferably, its Mohs hardness is 5 or less. The following whiskers can be preferably used: The whisker includes potassium titanate whisker (Mohs hardness: 3–4) calcium sulfate whisker (Mohs hardness: 3), magnesium sulfate whisker (Mohs hardness: 2–3), wollastonite (Mohs hardness: 4–5), zinc oxide whisker (Mohs hardness: 4), and calcium carbonate whisker (Mohs hardness: 3–4). The Mohs hardness of each of these whiskers is less than 5. Because the whisker consists of short fibers, it is present at a high percentage on the frictional surface of the friction plate and undergoes most of friction shear. Thus, the friction plate composed of any of these whiskers does not damage a mating member. The whiskers can be used singly or as a mixture thereof.

Whiskers commercially available include as calcium sulfate whiskers such as Franklin fiber A-30 (anhydrous salt type) and Franklin fiber H-30 (hemihydrate salt type, fiber length: 50–60μm, manufactured by Dainichiseika Co., Ltd), potassium titanate whiskers such as Tismo N (fiber length: 10–20μm, manufactured by Otsuka Chemical Co., Ltd), zinc oxide whiskers such as Panatetra (fiber length: 2–50μm, manufactured by Matsushita Electric Co., Ltd), and magnesium sulfate whiskers such as Moshidge (fiber length: 10–30 μm, manufactured by Ube Kosan Corp.).

The pitch type or PAN type carbon fiber can be blended in the resinous material. It is preferable to use a milled carbon fiber having a length in the range of 0.05 mm–0.1 mm. Although the carbon fiber is not limited to a specific kind, a product (carbonized product) prepared by calcining the carbon fiber at 1,000° C. is more favorable than a product prepared by calcining it at 2,000° C. or a product (graphitized product) prepared by calcining it at a temperature higher than 2,000° C. It is possible to use both a product calcined at a low temperature to allow it to have a low elasticity or a product calcined at a high temperature to allow it to have a high elasticity. The diameter of the carbon fiber is favorably ϕ20 μm or less and more favorably in the range of ϕ5μm to ϕ15 μm. The aspect ratio of the carbon fiber is favorably in the range of 5–80 μm and more favorably in the range of 20–50 μm.

The following carbon fibers are commercially available: As the carbon fiber of the pitch type, Kureka Milled M101S (manufactured by Kureha Chemical Co., Ltd) and Dona Carbon S241 (manufactured by Osaka Gas Chemical Co., Ltd) are exemplified. As carbon fiber of the PAN type, Besphite HTA-CMFO160-OH (manufactured by Toho Rayon Co., Ltd ) is exemplified.

It is preferable to add 3–40 parts by weight of the solid lubricant and/or the reinforcing material to 100 parts by weight of the resinous material. If more than 40 parts by weight of the solid lubricant and/or the reinforcing material is added to 100 parts by weight of the resinous material, it is difficult to mold a mixture thereof. On the other hand, if less than three parts by weight of the solid lubricant and/or the reinforcing material is added to 100 parts by weight of the resinous material, it is impossible for a resulting product to have superior resistance to wear and slidability performance.

Figure 2:
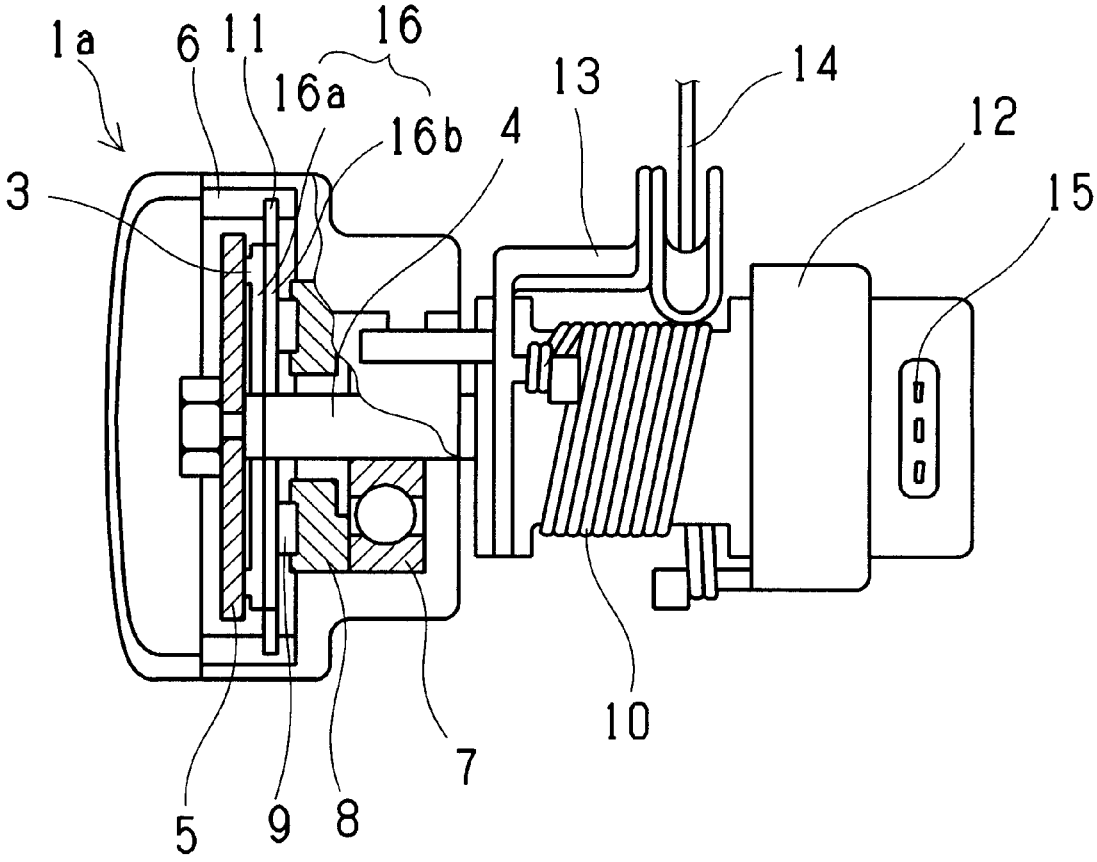
FIG. 2 shows another example of an apparatus for improving response sensitivity of accelerator operation.

FIG. 2 shows an example of a sensitivity improving apparatus installed at the end of a rotary shaft extending from an accelerator sensor unit.

A response sensitivity improving apparatus 1*a* has the same mechanism as that of the apparatus 1 shown in FIG. 2 except that the former has a different pressing device from that of the latter.

The pressing device 16 shown in FIG. 2 has a sheet-shaped friction plate 16*a*, for the response sensitivity improving apparatus, having an appropriate degree of frictional force and slidability and a metallic round plate-shaped member 16*b* for preventing deformation thereof such as flexure. The friction plate 16*a* is bonded to the plate-shaped member 16*b* to form the pressing device 16. A projection 11 is formed on the peripheral surface of the plate-shaped member 16*b*. The projection 11 fits in a concave portion 6 in the housing, thus preventing rotation of the pressing device 16.

The friction plate 16*a* is formed by adding a whisker whose Mohs hardness is 5 or less, carbon fibers or hard resinous powder to a fluorocarbon resin serving as a matrix resin singly or as a mixture thereof so that the friction plate 16*a* has an appropriate degree of frictional force and slidability performance, and in addition, a high degree of resistance to wear and creep. The friction plate 16*a* composed of the whisker whose Mohs hardness are 5 or less has an appropriate degree of frictional force and slidability performance and further a high degree of resistance to wear and creep.

As the whisker whose Mohs hardness is 5 or less, the above-described whiskers can be used. Any of these whiskers functions as an ingredient for reinforcing the microstructure of a fluorocarbon resin composition, thus greatly improving the resistance of the friction plate to creep and wear. Because the whisker consists of short fibers, it is present at a high percentage on the frictional surface of the friction plate and undergoes most of friction shear. Thus, the friction plate composed of any of these whiskers does not damage a mating member.

The whisker too short does not provide the friction plate with a sufficient resistance to creep and wear. Thus, it is preferable that the length of the whisker is about 5 μm. The calcium sulfate whisker of anhydrous salt type or hemihydrate salt type satisfies this condition. The calcium sulfate whisker of anhydrous salt type is more favorable than that of hemihydrate salt type.

It is possible to form the friction plate having an appropriate degree of frictional force and slidability performance and further a high degree of resistance to wear and creep by adding the above-described carbon fiber to the fluorocarbon resin instead of the whisker whose Mohs hardness is 5 or less.

It is possible to form the friction plate having the above-described excellent characteristics by adding the hard resinous powder to the fluorocarbon resin instead of the whisker whose Mohs hardness is 5 or less. The hard resinous powder means powder of synthetic resin which is not deformed at 380° C. at which the PTFE or modified PTFE that is used as the matrix resin is molded and can improve the resistance of the PTFE or the like to creep and wear. The following resins can be preferably used as the hard resinous powder: thermoplastic polyimide resin (manufactured by Mitsui Chemical Co., Ltd), thermosetting polyimide resin (manufactured by Furon Co., Ltd , Ube Kosan Corp.), polyether ether ketone resin (manufactured by VICTREX Corp.), aromatic polyester resin (manufactured by Sumitomo Chemical Co., Ltd), aromatic polyamide resin (manufactured by Sumitomo Chemical Co., Ltd), polyamide-imide resin (manufactured by Mitsubishi Chemical Co., Ltd ), epoxy resin, and phenol resin.

In consideration of moldability, it is preferable to use the hard resinous powder prepared by hardening thermosetting resin, heat-treating it at a high temperature of 500° C., and pulverizing it. It is also preferable to carbonize the thermosetting resin at 1,000° C. or higher and graphitize the thermosetting resin at 2,000° C. or higher. As the thermosetting resin, epoxy resin, polyimide resin, phenol resin, and the like can be used. The average diameter of pulverized powder is favorably 50μm or less and more favorably 25 μm or less. It is preferable that the powder is pulverized spherically. It is preferable to use spherical powder prepared by hardening phenol by reaction in a solution of paraformaldehyde and heat-treating it at 500 ° C. or higher and pulverizing it.

The following spherical graphitized powders are commercially available: Mesocarbon beads (manufactured by Osaka Gas Chemical Co., Ltd), Bellpearl (manufactured by Kanebo Co., Ltd ), Unibex (manufactured by Unitika Co., Ltd ), and Microcarbon beads (Manufactured by Nippon Carbon Co., Ltd ).

It is possible to use the whisker whose Mohs hardness is 5 or less, the carbon fiber, and the hard resinous powder singly or as a mixture thereof. For example, it is possible to use the whisker by mixing a plurality thereof with one another.

It is possible to use PTFE and/or the modified PTFE selectively from fluorocarbon resin to be used as the matrix resin of the friction plate.

The PTFE, which is a fluorocarbon resin, is a homopolymer of tetrafluoroethylene. The PTFE is commercially available in the trade names of Argofuron (manufactured by Ausimont Corp.), Teflon (manufactured by DuPont Corp.), Fruon (manufactured by ICI Corp.), and Polyfuron (manufactured by Daikin Chemical Co., Ltd). The PTFE is softened at 310–390° C. and can be compression-molded and extrusion-molded but cannot be injection-molded.

Modified PTFE preferable for the present invention is composed of the unit of the tetrafluoroethylene and the unit of substituted tetrafluoroethylene resulting from the substitution of the fluorine of the tetrafluoroethylene with organic radicals (—X). The chemical formula (1) of the modified tetrafluoroethylene is shown below. The organic radicals (—X) are not limited to specific ones, but perfluoroalkyl ether radical or fluoroalkyl radical is preferable. The addition of the PTFE shown in the chemical formula (1) to the matrix allows the friction plate to have an improve resistance to creep.

$$—[—CF_2—CF_2—]_m—[—CFX—CF_2]n—(1)$$

As the method of polymerizing the PTFE and the modified PTFE, it is possible to adopt the suspension polymerization method of polymerizing molding powder or the emulsion polymerization method of polymerizing fine powder. The molecular weight thereof is favorably in the range of about 500,000 to about 10,000,000 and more favorably, in the range of about 1,000,000 to about 7,000,000.

The following modified PTFE is commercially available: Teflon TG70J (manufactured by Mitsui DuPont Fluorochemical Co., Ltd ), Polyfron M111 (manufactured by Daikin Chemical Co., Ltd), and Hostafron TFM1600 (manufactured by Hoechst Corp.)

It is preferable to add 5–40 parts by volume of at least one of the whisker whose Mohs hardness is 5 or less, the carbon fiber, and the hard resinous powder to 100 parts by volume of the PTFE. If more than 40 parts by volume thereof is added to 100 parts by weight of the PTFE, it is difficult to mold a mixture thereof. On the other hand, if less than 5 parts by volume thereof is added to 100 parts by weight of the PTFE, the friction plate has a high degree of resistance to wear and creep.

EXAMPLES

The materials used for a pressing device in the examples and the comparative examples are shown below:

Resinous material

- PPS; #B160 (manufactured Toso Co., Ltd)
- PAI; TORLON (manufactured by Amoco Corp.)
- PI: AURUM450 (manufactured by Mitsui Chemical Co., Ltd
- Aromatic thermosetting resin; SK resin (manufactured by Sumikin Chemical Co., Ltd)
- POM; Juracon (manufactured by Polyplastic Co., Ltd) Solid lubricant
- Recycled PTFE; KT400H (manufactured by Kitamura Co., Ltd)

Reinforcing material

- Calcium carbonate whisker (Mohs hardness: 4); whisker AS3 (manufactured by Maruo Calcium Co., Ltd)
- Carbon fiber; M107T (Kureha Chemical Co., Ltd)

Examples 1–5 and Comparative Examples 1, 2

The components, shown in table 1, of each of the examples and the comparative examples were mixed with each other. Each mixture was granulated with a biaxial melt extruder. Each prepared pellet was injection-molded with an injection molder to prepare a ring-shaped specimen having dimensions of ϕ 50 mm×ϕ40 mm×6 mm to evaluate the characteristics thereof. The ratio of composition, shown in table 1, is indicated by part by weight.

Using the specimen, tests were conducted on the following items required as pressing device for the response sensitivity improving apparatus:

1) Friction test: The friction coefficient of each specimen was measured at first in the air (before durability test) and after the durability test that is described below was conducted in the following conditions. The number of rotations was 2.0 m/min, the load was 78.5N, and the atmospheric temperature was 80° C. The mating member was stainless steel.

2) Durability test: a durability test was conducted at 3,000,000 cycles in the air in the following conditions: pivotal angle was ±75 degrees, the speed was 1 Hz, the load was 78.5N, the atmospheric temperature was 80° C. The wear amount was measured after the durability test was conducted to examine the resistance of each specimen to wear. The change of the sliding-contact surface of the mating member was visually observed to examine the attacking property of each specimen. The specimens having little change were marked as ○, those having a little change were marked as Δ, and those having a great change were marked as X. Table 1 shows the result of the measurement.

On the other hand, the pressing device having the composition of each of the comparative examples 1 and 2 was inferior to that of each of the example 1 through 5 in durability and resistance to wear. The test for the specimen of the comparative example 1 was stopped because it was worn prior to 1,000,000 cycles.

The pressing device of the present invention, for the sensitivity improving apparatus, is a molded product of the resinous material having a flexural strength of 50 MPa or higher and a flexural modulus of elasticity of 3,300 MPa or higher. Thus, it is possible to provide the pressing device as a monoblock molded product having an appropriate degree of frictional force and slidability performance, an improved resistance to wear, and property of hardly attacking the mating member. Consequently, the pressing device allows a driver to operate the accelerator pedal comfortably. Also, the pressing device eliminates the need for a metallic reinforcing material. Thus, the pressing device has a light weight and a long life.

Further, because the pressing device is injection-moldable, it has a high productivity.

Moreover, the resinous material of the pressing device is composed of one or more resins selected from the specified resins and the solid lubricant. Thus, the pressing device has a higher resistance to wear and hardly attacks the mating member.

Because the pressing device is the molded product of the resinous material consisting of the thermosetting resin, the pressing device consisting of the thermosetting resin satisfies the above-described characteristics.

TABLE 1

| | Example | | | | | Comparative Example | |
|---|---|---|---|---|---|---|---|
| | 1 | 2 | 3 | 4 | 5 | 1 | 2 |
| Composition | | | | | | | |
| PPS | 100 | — | — | — | — | — | 100 |
| PAI | — | 100 | — | — | — | — | — |
| PI | — | — | 100 | — | — | — | — |
| Aromatic thermosetting resin | — | — | — | 100 | — | — | — |
| POM | — | — | — | — | 100 | 100 | — |
| PTFE | 30 | 20 | 20 | — | 5 | — | 50 |
| Calcium carbonate whisker | — | 10 | — | — | — | — | 8 |
| Carbon fiber | — | — | — | — | 15 | — | — |
| Characteristic of molded product | | | | | | | |
| Flexural rigidity | 60 | 150 | 100 | 90 | 160 | 100 | 40 |
| Flexural modulus of elasticity | 3300 | 5000 | 3500 | 10000 | 5200 | 2600 | 3300 |
| Evaluation test | | | | | | | |
| Friction coefficient | | | | | | | |
| Initial | 0.17 | 0.18 | 0.17 | 0.20 | 0.19 | 0.16 | 0.14 |
| after durability test | 0.19 | 0.20 | 0.19 | 0.22 | 0.22 | — | 0.19 |
| Resistance to wear | ○ | ○ | ○ | ○ | Δ | X | X |
| Mating member-attacking property | ○ | ○ | ○ | ○ | ○ | — | ○ |

As apparent from table 1, the friction coefficient value measured after the durability test of the pressing device, for the response sensitivity improving apparatus of the present invention was hardly different from the initial value. The pressing device was also superior in the resistance to wear and did not have attacking property against the mating member.

Table 1 indicates that the present invention can be preferably applied to the pressing device of the response sensitivity improving apparatus.

The examples of the friction plate are described below.

The materials used for the friction plate in the examples and the comparative examples are shown below:

Fluorocarbon resin

PTFE; Teflon 7J (manufactured Mitsui DuPont Fluoro Chemical Co., Ltd)

Modified PTFE; Teflon TG70J (manufactured by Mitsui DuPont Fluoro Chemical Co., Ltd)

Calcium sulfate whisker (anhydrous salt type, Mohs hardness: 3); Franklin fiber A-30 (manufactured by Dainichiseika Co., Ltd)

Wollastonite (Mohs hardness: 4.5) whisker; Kemolit (manufactured by Maruwa Biochemical Co., Ltd)

Aluminum borate whisker (Mohs hardness: 7); Alborex-Y (manufactured by Shikoku Chemical Co., Ltd)

Carbon fiber (pitch type); Kureka Milled M101S (manufactured by Kureha Chemical Co., Ltd)

Glass fiber; MF-KAC (Asahi Fiberglass Co., Ltd)

Polyimide resin powder (thermosetting type); (manufactured by Furon Co., Ltd)

Polyamideimide resin powder; (produced by Mitsubishi Chemical Co., Ltd)

Examples 6–7, Comparative Examples 3–5

Using a Henschel dry mixer, the above-described materials were mixed with each other. Then, cylindrical materials of ϕ124 mm×ϕ64 mm×100 mm were preformed and calcined by free baking method at 370° C. for 4 hours. The ratio of composition, shown in table 2, is indicated by part by volume. Then, the semi-finished products were skived to a thickness of 2 mm to prepare ring-shaped sheet specimens having a size of ϕ450 mm×ϕ40 mm×2 mm. One surface of each specimen was etched an alkali solution so that it is adhesive. The specimen was bonded to one surface of a jig made of stainless steel (ϕ50 mm×ϕ15 mm×4 mm) with an epoxy adhesive agent to prepare specimens whose characteristics were examined.

Using the specimens and carrying out a method similar to that of the example 1, evaluation test were conducted to examine the items, of each specimen, required as the friction plate for the sensitivity improving apparatus. The thickness of each specimen was measured after the durability test was conducted to examine the resistance of each specimen to creep. The specimens were evaluated on the items by the standard similar to that of the example 1. Table 2 shows the result of the measurement and the evaluation. Table 2

As apparent from table 2, the initial value of the friction coefficient of the friction plate, for the sensitivity improving apparatus, of the present invention was hardly different from the value measured after the durability test was conducted. The friction plate of the present invention was also superior in the resistance to wear and creep and did not have attacking property against the mating member.

Table 2 indicates that the present invention can be preferably applied to the friction plate of the sensitivity improving apparatus.

On the other hand, the friction plate having the composition of each of the comparative examples was inferior to that of each of the examples in durability and resistance to wear (comparative example 3). Because the Mohs hardness of the specimens (comparative examples 4 and 5) is more than 5, they attacked the mating member in a high degree. The test for the specimen of the comparative example 3 not containing the ingredient was stopped because it was worn prior to 1,000,000 cycles.

The friction plate, of the present invention, for the sensitivity improving apparatus is formed of the fluorocarbon resin and at least one of the whiskers whose Mohs hardness is 5 or less, the carbon fiber, and the hard resinous powder. Further, the fluorocarbon resin consists of at least one resin selected from tetrafluoroethylene and modified tetrafluoroethylene. Accordingly, the friction plate has an appropriate degree of a frictional force and sliding-contact performance, and a greatly improved resistance to wear and creep. Consequently, the pressing device allows the driver to operate the accelerator pedal favorably and contributes to the production of the sensitivity improving apparatus having a longer life than the conventional one.

What is claimed is:

1. A friction plate for an apparatus in which a friction resistance is imparted to a rotary shaft that drives a vehicle engine-output control device directly or indirectly in response to operation of an accelerator, said friction plate comprising:

a resinous material consisting of a fluorocarbon resin and at least one ingredient selected from the group consisting of a whisker whose Mohs hardness is 5 or less, a carbon fiber, and a hard resinous powder.

| | Example | | | | | | Comparative Example | | |
|---|---|---|---|---|---|---|---|---|---|
| | 6 | 7 | 8 | 9 | 10 | 11 | 3 | 4 | 5 |
| Composition | | | | | | | | | |
| PTFE | — | 100 | — | — | — | 100 | — | 100 | 100 |
| Modified PTFE | 100 | — | 100 | 100 | 100 | — | 100 | — | — |
| Calcium sulfate whisker | 30 | — | — | — | — | 10 | — | — | — |
| Wollastonite whisker | — | 40 | — | — | — | — | — | — | — |
| Aluminum borate whisker | — | — | — | — | — | — | — | 25 | — |
| Carbon fiber | — | — | 25 | — | — | 10 | — | — | — |
| Glass fiber | — | — | — | — | — | — | — | — | 20 |
| Polyimide resin powder | — | — | — | 25 | — | — | — | — | — |
| Polyamideimide resin powder | — | — | — | — | 5 | — | — | — | — |
| Evaluation test | | | | | | | | | |
| Friction coefficient | | | | | | | | | |
| Initial | 0.14 | 0.16 | 0.17 | 0.13 | 0.14 | 0.16 | 0.11 | 0.21 | 0.23 |
| after durability test | 0.17 | 0.18 | 0.18 | 0.16 | 0.17 | 0.17 | — | 0.26 | 0.27 |
| Resistance to wear | ○ | ○ | ○ | ○ | ○ | ○ | X | ○ | ○ |
| Resistance to creep | ○ | ○ | ○ | ○ | Δ | ○ | X | ○ | ○ |
| Mating member-attacking property | ○ | ○ | ○ | ○ | ○ | ○ | ○ | X | X |

2. A friction plate according to claim 1, wherein said fluorocarbon resin consists of at least one resin selected from the group consisting of tetrafluoroethylene and modified tetrafluoroethylene.

3. A friction plate according to claim 1, wherein 5–40 parts by volume of said ingredient is added to 100 parts by volume of said fluorocarbon resin.

4. In a pressing device for an apparatus in which a friction resistance is imparted to a rotary shaft that drives a vehicle engine-output control device directly or indirectly in response to operation of an accelerator, the improvement which comprises a friction plate comprising:

a friction plate; and a plate-shaped member that is bonded to the friction plate, wherein said friction plate comprises a resinous material consisting of a fluorocarbon resin, and at least one ingredient selected from the group consisting of a whisker whose Mohs hardness is 5 or less, a carbon fiber, and a hard resinous powder.

* * * * *